US005553869A

United States Patent [19]

Stamback

[11] Patent Number: 5,553,869

[45] Date of Patent: Sep. 10, 1996

[54] BONDED VALVE STEM SEAL WITH RETAINER TANGS

[75] Inventor: Mark A. Stamback, Cambridge City, Ind.

[73] Assignee: Dana Corporation, Toledo, Ohio

[21] Appl. No.: 354,186

[22] Filed: Dec. 12, 1994

[51] Int. Cl.[6] ..... F16J 15/32; F01L 3/08

[52] U.S. Cl. ..... 277/33; 277/152; 277/166; 277/178; 277/189; 123/188.6

[58] Field of Search ..... 277/189, 178, 277/152–153, 187, 38, 39, 173, 174, 175, 208, 166, 33; 123/188.6

[56] References Cited

U.S. PATENT DOCUMENTS

| | | | |
|---|---|---|---|
| 2,859,993 | 10/1956 | Estey | 288/9 |
| 2,926,938 | 3/1960 | Ratti | 277/152 |
| 3,480,286 | 11/1969 | Kosatka | 277/182 |
| 3,601,420 | 8/1971 | Binford | 277/212 |
| 4,125,265 | 11/1978 | Grzesiak | 277/152 |
| 4,811,704 | 3/1989 | Boehmer et al. | 277/152 |
| 4,909,202 | 3/1990 | Binford et al. | 123/188 |
| 4,947,811 | 8/1990 | Binford | 123/188 |
| 5,237,971 | 8/1993 | Worsley | 123/188.6 |

FOREIGN PATENT DOCUMENTS

| | | | |
|---|---|---|---|
| 2057627 | 4/1971 | France . | |
| 146770 | 7/1920 | United Kingdom | 123/188.6 |

*Primary Examiner*—William A. Cuchlinski, Jr.
*Assistant Examiner*—John L. Beres
*Attorney, Agent, or Firm*—Rader, Fishman & Grauer PLLC

[57] ABSTRACT

An inventive valve stem seal assembly includes a seal body bonded to a metal retainer without the need for a separate retaining ring or a garter spring. Compressive radial force between the seal body and a corresponding engagement surface of a valve stem is provided by an end wall of the retainer, and in particular, tangs which extend generally longitudinally away from the end wall. The seal body envelops the tangs, and the tangs selectively flex when a valve stem is inserted through an aperture of the seal body.

14 Claims, 1 Drawing Sheet

BONDED VALVE STEM SEAL WITH RETAINER TANGS

FIELD OF THE INVENTION

The present invention relates to valve stem seals utilized in an intake and exhaust head assembly of internal combustion engines. More particularly, the invention relates to a seal body bonded to a metal retainer with a plurality of retainer tangs, eliminating a need for a separate retaining ring or a garter spring.

BACKGROUND OF THE INVENTION

Internal combustion engines comprise intake and exhaust valves, each valve including a head and a valve stem integrally secured to the head, and reciprocally mounted in a valve stem guide. As the valve stem typically operates in a substantial volume of lubricating oil, it is preferable to limit the amount of oil consumed by the engine. To control oil consumption, valve stem seal assemblies are mounted on the valve guides to meter oil flow between the stems and guides.

Valve stem seal assemblies are known which include a metallic casing or shell adapted to retain a resilient seal body, the seal body typically made of an elastomer base material. A garter spring or retaining ring is supported in an exterior external groove of the seal body, and used to provide a radially compressive force between the seal body and the stem. Such garter springs or retaining rings may be time-consuming or difficult to install, and are subject to unwanted separation from the rest of the assembly. Nor are they protected from adverse operational conditions of internal combustion engines. The adverse conditions include elevated engine temperature, corrosion, loss of spring load, and the possibility of the component becoming nonfunctional. Therefore, unwanted assembly failure may result.

SUMMARY OF THE INVENTION

The present invention is directed to a valve stem seal assembly adapted for securement to a valve guide of an internal combustion engine. The assembly comprises both a retainer and a resilient seal body, portions of the retainer and seal body comprising a retention sub-assembly to eliminate the need for a separate retaining ring or a garter spring.

The metal retainer extends along a longitudinal axis and includes a lower shell portion and an end wall. The end wall defines an opening and comprises a plurality of tangs which are formed by bending a portion of the end wall about an annular base to extend generally longitudinally away from the lower shell portion. Interposed between each of the tangs is a tab that extends generally radially inwardly from the base. Tangs may extend radially as well as longitudinally, but have a radial extent less than that of the tabs.

The resilient seal body is bonded to and receives structural support from the retainer. The seal body includes a base portion defining a valve stem aperture. The inner periphery of the aperture includes at least one integrally formed annular lip that projects radially inwardly into the aperture. The end wall and the base portion form a retention sub-assembly that sealingly engages a sealing surface of the valve stem by means of an interference fit. The retention sub-assembly is integral to the end wall of the retainer and the base portion of the seal body to prevent separation of the retention sub-assembly from the retainer and the seal body.

In a preferred embodiment, portions of the end wall, especially the tangs, are adapted to selectively flex to promote the interference fit, eliminating the need for an externally disposed retaining ring or garter spring. Such an external ring or spring may be time-consuming or difficult to install. Nor is there the possibility of unwanted separation of the retention sub-assembly from the rest of the retainer. Further, the base portion of the seal body envelops the tangs and the tabs of the end wall, protecting them from the adverse operational conditions of the internal combustion engine.

A method of making the valve stem seal assembly comprises the steps of stamping the retainer, piercing an opening through the end wall, and forming the tangs by bending a portion of the end wall about an annular base to extend longitudinally away from the shell portion. Thus, the tangs comprise an upstanding portion of the end wall. Radially inwardly extending tabs are interposed between the tangs. The seal body is then molded to the retainer.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF A PREFERRED EMBODIMENT

Figure 1:
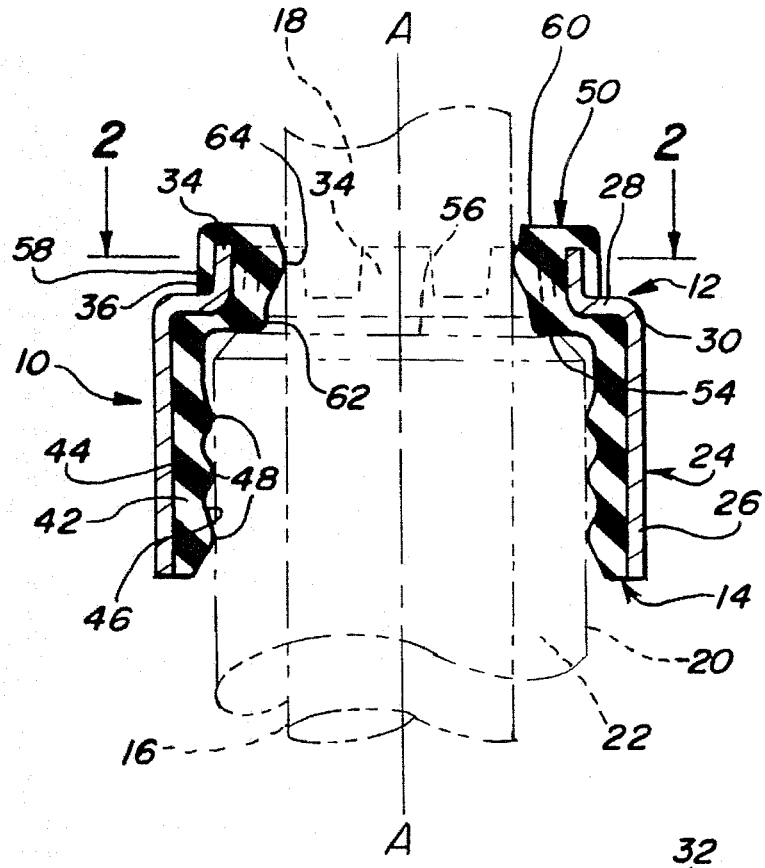
FIG. 1 is a cross-sectional view of a valve stem seal assembly incorporating the present invention.

A valve stem seal assembly 10 illustrated in the figures includes a metal cylindrical retainer 12 extending about a longitudinal axis A—A and a resilient seal body 14 secured to retainer 12. Body 14 sealingly engages both an outer circumferential sealing surface 16 of an annular valve stem 18 and an outer circumferential sealing surface 20 of an annular valve guide 22. Valve stem seal assembly 10 is used to control oil consumption associated with the reciprocal movement of stem 18 within guide 22.

Figure 3:
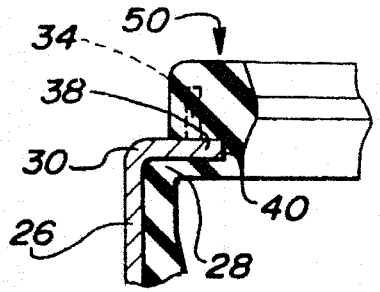
FIG. 3 is a cross-sectional view of the present invention taken along line 3—3 of FIG. 2.
Figure 2:
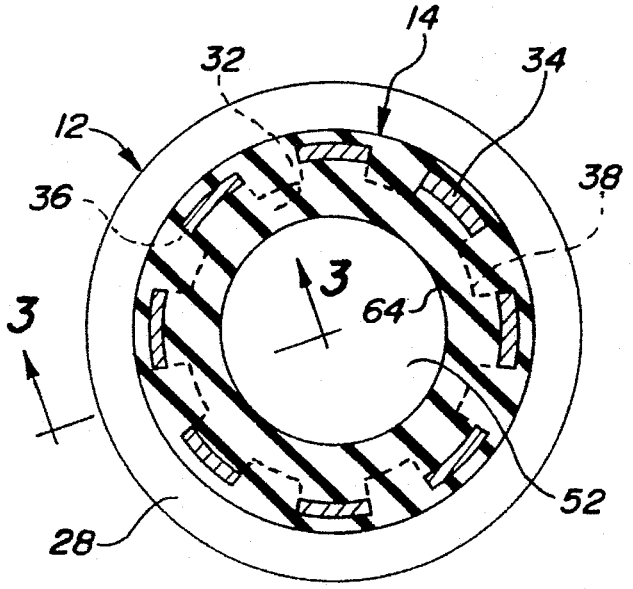
FIG. 2 is a cross-sectional view of an embodiment of the present invention taken along line 2—2 of FIG. 1.

Retainer 12 includes a longitudinally extending rigid lower shell portion 24 defined by a cylindrical wall 26, and a radially inwardly extending end wall 28 at an end 30 of wall 26 defining an opening 32. As shown in FIGS. 1 through 3, retainer 12 also has a plurality of equally spaced retainer tangs 34. In a preferred embodiment, there are eight (8) such tangs. Tangs 34 are formed by bending a portion of end wall 28 about an annular base 36 to extend generally longitudinally away from the lower shell portion. Interposed between each of the tangs is a tab that extends generally radially inwardly from base 36 and includes an inner edge 40. Comprised from an upstanding portion of end wall 28, tangs 34 extend generally longitudinally away from shell portion 24. However, tangs 34 may also include a radial extent less than that of tabs 38. In one preferred embodiment, tangs 34 extend along an axis parallel to longitudinal axis A—A, having the advantage of easier manufacturing. In an alternative preferred embodiment they extend both longitudinally and radially inwardly of base 36 to provide additional radial compressive force as discussed further below.

Seal body 14 is bonded to retainer 12. Preferably, it is molded to the retainer. Seal body 14 includes a valve guide sealing portion with a longitudinally extending lower annular skirt 42. Skirt 42 has a generally smooth outer periphery 44 in facial contact with cylindrical wall 26 of shell portion 24. Skirt 42 also has an inner periphery 46 with a series of integrally formed annular ribs or lips 48 that project radially inwardly. When valve guide 22 is inserted into shell 24, skirt 42 of seal body 14 is designed to radially compress. Outer periphery 44 forced against rigid cylindrical wall 26 such that lips 48 sealingly engage sealing surface 20 of valve guide 22, forming an interference fit.

Seal body 14 also includes a valve stem sealing portion with a base portion 50 that extends radially inwardly from annular skirt 24 to define a valve stem aperture 52. Bottom surface 54 of base portion 50 comes into selective contact with top 56 of valve guide 22 when retainer 12 is mounted on the valve guide. Base portion 50 is bonded to and receives structural support from end wall 28, and in particular tangs 34 and tabs 38, which are enveloped by the base portion. In particular, base portion 50 preferably has a generally smooth, uninterrupted outer periphery 58 with a greater radial extent than tangs 34 and an upper surface 60 with a greater longitudinal extent than tangs 34. Aperture 52 is smaller than opening 32 of end wall 28 such that an inner periphery 62 of aperture 52 extends radially inwardly a greater extent than do tabs 38 of end wall 28.

Inner periphery 62 of base portion 50 includes at least one integrally formed annular rib or lip 64 that projects radially inwardly into aperture 52. When valve stem 18 is inserted through aperture 52, base portion 50, and lip 64 in particular, radially compress. Further, portions of end wall 28, including tangs 34, may flex. Thus, base portion 50 and end wall 28 work together as a retention sub-assembly to provide the necessary sealing engagement between retainer 12 and sealing surface 16 of valve stem 18 by promoting an interference fit. End wall 28, and especially tangs 34, provide a compressive force between base portion 50 of seal body 14 and valve stem 18. The ways in which the degree of compressive force may be varied include altering the composition of seal body 14, the radial extent of lip 64, the number of tangs 34 and tabs 38, the longitudinal and radial extent of each individual tang, and the radial extent of each tab 38. In particular, tangs 34 are more likely to flex when they are directed radially inwardly as well as longitudinally away from shell 24.

Figure 4:
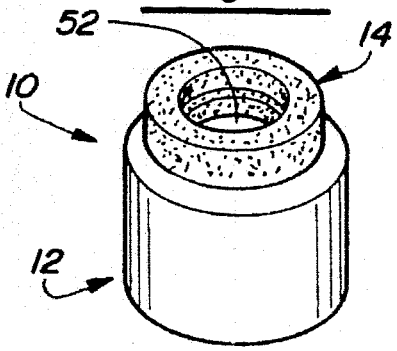
FIG. 4 is a perspective view of the present invention.

The use of end wall 28, enveloped within seal body 14, to provide the necessary sealing engagement between valve stem 18 and retainer 12 provides a number of advantages over the prior art use of externally disposed retaining rings or garter springs, as best illustrated using FIG. 4. In particular, unlike garter springs and retaining rings which may be time-consuming or difficult to install, tangs 34 are integral with retainer 12, seal body 14 bonded in turn to the retainer. Thus, no extra assembly is required. Nor, in contrast to externally disposed retainers and springs, is there a possibility of unwanted separation of the retention sub-assembly from the rest of retainer 12. Further, tangs 34 and tabs 38 are protected from the adverse operational conditions of the internal combustion engine, extending the operational life of the critical valve stem seal assembly 10.

A method of making and using assembly 10 comprises the initial step of stamping retainer 12. Cylindrical wall 26 of rigid lower shell portion 24 is dimensioned to provide the necessary structural support to annular skirt 42 of seal body 14 such that a compressive radial force is created between valve guide 22 and seal body 14. The stamping process also includes the step of forming end wall 28 at end 30 of wall 26. Next a piercing operation forms opening 32. Tangs 34 are formed by bending a portion of end wall 28 about an annular base to extend longitudinally away from shell portion 24. Thus, tangs 34 comprise an upstanding portion of end wall 28. Tabs 38 are interposed between each of tangs 34. A plurality of slits may be cut radially outwardly from an inner periphery of opening 32 and stopping at the location of base 36, the slits defining the annular extent of tangs 34 and aiding in tang formation. As discussed above, the longitudinal and radial extent of tangs 34 affect the amount of flexing and resulting radial compressive load created between base portion 50 and valve stem 18.

Preferably, seal body 14 is molded to retainer 12. Specifically, the valve guide seal portion is formed from annular skirt 42 which is bonded to wall 26 of retainer 12 and includes a plurality of integral inwardly projecting lips 48 which engage valve guide 22. Seal body 14 also includes integral base portion 50, which envelops end wall 28 and in particular tangs 34 and tabs 38, with aperture 52 formed therethrough to receive valve stem 18. Base portion 50 includes at least one integral radially inwardly projecting lip 64 that engages valve stem 18 as it passes through aperture 52, base portion 50 of seal body 14 and end wall 28, in particular tangs 34 of retainer 12, working in combination to provide the necessary sealing engagement to limit unwanted oil leakage.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A valve stem seal assembly adapted for securement to a valve guide of an internal combustion engine, comprising:

a metal cylindrical retainer extending along a longitudinal axis with a lower shell portion and an end wall, said end wall defining an opening and including a plurality of tangs extending longitudinally away from said shell portion and having a radial extent inwardly of said lower shell portion; and a resilient seal body bonded to and receiving structural support from said retainer, said seal body including a base portion defining a valve stem aperture, an inner periphery of said aperture including at least one integrally formed annular lip that projects radially inwardly into said aperture, said end wall and said base portion forming a retention sub-assembly that sealingly engages a sealing surface of the valve stem by means of an interference fit.

2. A valve stem seal assembly as recited in claim 1, wherein said retention sub-assembly is integral to said end wall of said retainer and said base portion of said seal body to prevent separation of said retention sub-assembly from said retainer and said seal body.

3. A valve stem seal assembly as recited in claim 2, wherein said base portion of said seal body includes a generally smooth, uninterrupted outer periphery.

4. A valve stem seal assembly as recited in claim 1, wherein said tangs of said end wall selectively flex to promote said interference fit.

5. A valve stem seal assembly as recited in claim 1, wherein said base portion of said seal body envelops a portion of said end wall including said tangs, protecting said portion of said end wall and said tangs from adverse operational conditions of the internal combustion engine.

6. A valve stem seal assembly as recited in claim 1, wherein each of said tangs of said end wall extends from an annular base, said end wall further including tabs interposed between said tangs, said tabs extending radially inwardly from said base.

7. A valve stem seal assembly as recited in claim 1, wherein said seal body is molded to said retainer.

8. A valve stem seal assembly adapted for securement to a valve guide of an internal combustion engine, comprising:

a metal cylindrical retainer extending along a longitudinal axis with a lower shell portion and an end wall, said end wall defining an opening and including a plurality of tangs extending longitudinally away from said shell portion, wherein each of said tangs of said end wall extends from an annular base, said end wall further including tabs interposed between said tangs, said tabs extending generally radially inwardly from said base; and a resilient seal body bonded to and receiving structural support from said retainer, said seal body including a base portion defining a valve stem aperture, an inner periphery of said aperture including at least one integrally formed annular lip that projects radially inwardly into said aperture, said end wall and said base portion forming a retention sub-assembly that sealingly engages a sealing surface of the valve stem by means of an interference fit, wherein said retention sub-assembly is integral to said end wall of said retainer and said base portion of said seal body to prevent separation of said retention sub-assembly from said retainer and said seal body, said tangs of said end wall adapted to selectively flex to promote said interference fit.

9. A valve stem seal assembly as recited in claim 8, wherein said base portion of said seal body envelops said tangs and said tabs of said end wall, protecting them from adverse operational conditions of the internal combustion engine.

10. A valve stem seal assembly adapted for securement to a valve guide of an internal combustion engine, comprising:

a metal cylindrical retainer extending along a longitudinal axis with a lower shell portion and an end wall, said end wall defining an opening and including a plurality of tangs extending longitudinally away from said shell portion, wherein each of said tangs of said end wall extends from an annular base, said end wall further including tabs interposed between said tangs, said tabs extending radially inwardly from said base; and a resilient seal body bonded to and receiving structural support from said retainer, said seal body including a base portion defining a valve stem aperture, an inner periphery of said aperture including at least one integrally formed annular lip that projects radially inwardly into said aperture, said end wall and said base portion forming a retention sub-assembly that sealingly engages a sealing surface of the valve stem by means of an interference fit.

11. A valve stem seal assembly as recited in claim 10, wherein said tangs extend from said base and include a radial extent.

12. A valve stem seal assembly as recited in claim 11, wherein said tangs have a radial extent less than that of said tabs.

13. A valve stem seal assembly as recited in claim 12, wherein said tangs and said tabs are equally spaced about said opening of said end wall.

14. A valve stem seal assembly as recited in claim 13, wherein there are eight of said tangs.

* * * * *